US009329574B2

(12) United States Patent
Momose

(10) Patent No.: US 9,329,574 B2
(45) Date of Patent: May 3, 2016

(54) TIMEPIECE WITH INDEXED ANNULAR MEMBER AROUND DIAL

(71) Applicant: Seiko Epson Corporation, Tokyo (JP)

(72) Inventor: Tomonori Momose, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/591,234

(22) Filed: Jan. 7, 2015

(65) Prior Publication Data

US 2015/0205263 A1 Jul. 23, 2015

(30) Foreign Application Priority Data

Jan. 21, 2014 (JP) ..... 2014-008440

(51) Int. Cl.

| | |
|---|---|
| ***G04B 19/06*** | (2006.01) |
| ***G04R 60/12*** | (2013.01) |
| ***G04B 19/10*** | (2006.01) |
| ***G04B 19/12*** | (2006.01) |

(52) U.S. Cl.

CPC ..... *G04B 19/06* (2013.01); *G04B 19/10* (2013.01); *G04B 19/12* (2013.01); *G04R 60/12* (2013.01)

(58) Field of Classification Search

CPC ..... G04B 19/06; G04B 19/10; G04B 19/12; G04B 19/18; G04G 17/00; G04R 60/00; G04R 60/10; G04R 60/12

See application file for complete search history.

(56) References Cited

U.S. PATENT DOCUMENTS

| | | | | |
|---|---|---|---|---|
| 584,923 | A * | 6/1897 | Conkling | 368/316 |
| 3,528,240 | A * | 9/1970 | Kupchick | 368/295 |
| 5,793,710 | A * | 8/1998 | Jacobi, Jr. | 368/223 |
| 6,052,339 | A * | 4/2000 | Frenkel et al. | 368/230 |
| 6,229,766 | B1 * | 5/2001 | Saurer et al. | 368/205 |
| 2002/0044501 | A1 | 4/2002 | Sato | |
| 2009/0104409 | A1 * | 4/2009 | Derriey et al. | 428/172 |
| 2009/0201771 | A1 * | 8/2009 | Miyahara | 368/47 |
| 2010/0144300 | A1 * | 6/2010 | Someya | 455/233.1 |
| 2011/0103199 | A1 * | 5/2011 | Winkler et al. | 368/285 |
| 2011/0222378 | A1 * | 9/2011 | Vuille et al. | 368/232 |
| 2012/0105288 | A1 * | 5/2012 | Abe | 343/702 |
| 2012/0120776 | A1 * | 5/2012 | Fleury et al. | 368/205 |
| 2014/0241131 | A1 * | 8/2014 | Honda | 368/47 |

FOREIGN PATENT DOCUMENTS

| | | | |
|---|---|---|---|
| CH | 316830 | | 12/1956 |
| JP | 2000-275360 | A | 10/2000 |
| JP | 2005-164273 | A | 6/2005 |
| JP | 2006-214734 | A | 8/2006 |
| JP | 2009-063490 | A | 3/2009 |

* cited by examiner

*Primary Examiner* — Amy Cohen Johnson
*Assistant Examiner* — Matthew Powell

(57) ABSTRACT

An electronic timepiece has a dial; a dial ring disposed around the outside circumference of the dial; and an index marker affixed to the dial ring. The dial ring has a protruding part that protrudes to the inside in the radial direction of the dial ring; and the index marker is disposed to the protruding part. The annular member is made of plastic, and the index marker is made of metal.

12 Claims, 10 Drawing Sheets

TIMEPIECE WITH INDEXED ANNULAR MEMBER AROUND DIAL

CROSS-REFERENCE TO RELATED APPLICATION

This application claims priority under 35 U.S.C. §119 to Japanese Application No. 2014-008440, filed on Jan. 21, 2014, the content of which is hereby incorporated by reference in its entirety.

BACKGROUND

1. Technical Field

The present invention relates to a timepiece.

2. Related Art

A dial ring with markers may be disposed around the outside circumference of the dial of a timepiece. For structural and design reasons, the dial ring must be molded into a complicated shape of protrusions and recesses, and is therefore typically made of plastic.

However, while a luxurious design is needed for qualitative and product differentiation and to improve product value, a sufficiently luxurious appearance cannot be achieved by simply processing a molded plastic dial ring. Metal characters have therefore affixed as markers on the dial to achieve a luxury appearance in the related art. See, for example, JP-A-2009-63490 and JP-A-2006-214734.

However, in a solar powered timepiece the exposed area of the solar cell must be as large as possible, the area where characters can be placed on the dial is confined, and design improvements are therefore limited.

SUMMARY

With consideration for this problem, an object of the present invention is to provide a timepiece excellent design characteristics.

A timepiece according to one aspect of the invention has a dial; an annular member disposed around the outside circumference of the dial; and an index marker affixed to the annular member.

In the invention, a member that is separate from the annular member can be used as an index marker, and the design can therefore be improved.

Note that here and below, "annular" means a continuous, unbroken ring shape, but is not limited to round rings and includes unbroken rectangles and other polygons. In addition, an index marker includes letters, abbreviations, numerals, and other shapes for indicating time.

In a timepiece according to another aspect of the invention, the annular member is preferably made of plastic; and the index marker is made of metal.

This configuration enables molding the annular member from plastic and therefore simplifies processing complicated shapes. Furthermore, because the index marker is made from metal, a luxurious design can be achieved.

In a timepiece according to another aspect of the invention, the annular member preferably has a protruding part that protrudes to the inside in the radial direction of the annular member; and the index marker is disposed to the protruding part. This configuration simplifies production because the index marker is attached to the protruding part.

In a timepiece according to another aspect of the invention, the outside end of the index marker in the radial direction is preferably positioned further to the outside in the radial direction than the inside edge of the annular member in the radial direction.

When the index markers are disposed to the dial, the outside end of the index marker in the radial direction is at most located at the inside edge of the annular member in the radial direction even if the index markers are disposed to the position at the farthest outside in the radial direction. However, because the protruding part is configured so that the outside end of the index marker in the radial direction is positioned further to the outside in the radial direction than the inside edge of the annular member in the radial direction, the area of the dial covered by the index marker is smaller than when the index marker is disposed to the dial, and the visible area of the dial can therefore be increased.

In a timepiece according to another aspect of the invention, the index marker is preferably fastened to the annular member by adhesive. This simplifies production.

In a timepiece according to another aspect of the invention, the index marker preferably has a post member; the protruding part has a first hole at a position corresponding to the post member; and the post member is fit into the first hole and fastened in the first hole by adhesive.

Because the post member of the index marker fits into the first hole and is fastened in the first hole by adhesive, the adhesive cannot be seen from the index marker side when using the timepiece and does not detract from the appearance.

In a timepiece according to another aspect of the invention, the protruding part preferably has a second hole that communicates with the first hole from the opposite side as the side in which the first hole is formed, and the adhesive is applied from the second hole side.

Because the post member of the index marker is fit into the first hole, adhesive is applied from the second hole side, and the post member is bonded by adhesive in the first hole, the adhesive cannot be seen from the index marker side and does not detract from the appearance.

In a timepiece according to another aspect of the invention, there are preferably plural post members and first holes; and the second hole is a single oval hole that communicates with the plural first holes.

Because the second hole is a single oval hole and communicates with the plural first holes in this configuration, the second hole becomes an adhesive pool, adhesion increases, and strength can be increased.

In a timepiece according to another aspect of the invention, the length of the protruding part in the radial direction of the annular member, and the width of the protruding part in the circumferential direction of the annular member, are preferably less than the length in the radial direction and the width in the circumferential direction of the index marker.

When viewed from the index marker side in this configuration, the protruding part is difficult to see and does not detract from the appearance.

In a timepiece according to another aspect of the invention, when the post member is fastened in the first hole or the second hole, the length of the post member that protrudes from the first hole or the second hole is greater than or equal to ½ the depth of the first hole or the second hole. This configuration increases the area that can be fastened with adhesive, and can increase strength.

In a timepiece according to another aspect of the invention, the protruding part preferably has a portion that is parallel to the dial; and the index marker is disposed to the parallel portion.

This configuration simplifies manufacturing an annular member with protruding parts. Note that here and in the following description, "parallel" as used in the invention includes manufacturing deviations within +/−2 degrees.

In a timepiece according to another aspect of the invention, the index marker preferably has a constant thickness.

This configuration simplifies manufacturing the index markers. Note that "constant" as used in the invention includes manufacturing deviations within +/−2 degrees here and in the following description.

A timepiece according to another aspect of the invention preferably also has an antenna that receives radio signals and is disposed to a position not overlapping the index marker in plan view.

Because the antenna and the index marker do not overlap in plan view in this configuration, the reception sensitivity of the antenna is not impaired.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures. Note that the size and scale of parts shown in the figures differ from the actual size and scale for convenience. Furthermore, the following examples are specific preferred embodiments of the invention and describe technically desirable limitations, and the scope of the invention is not limited thereby unless such limitation is specifically stated below.

Embodiment 1

Figure 1:
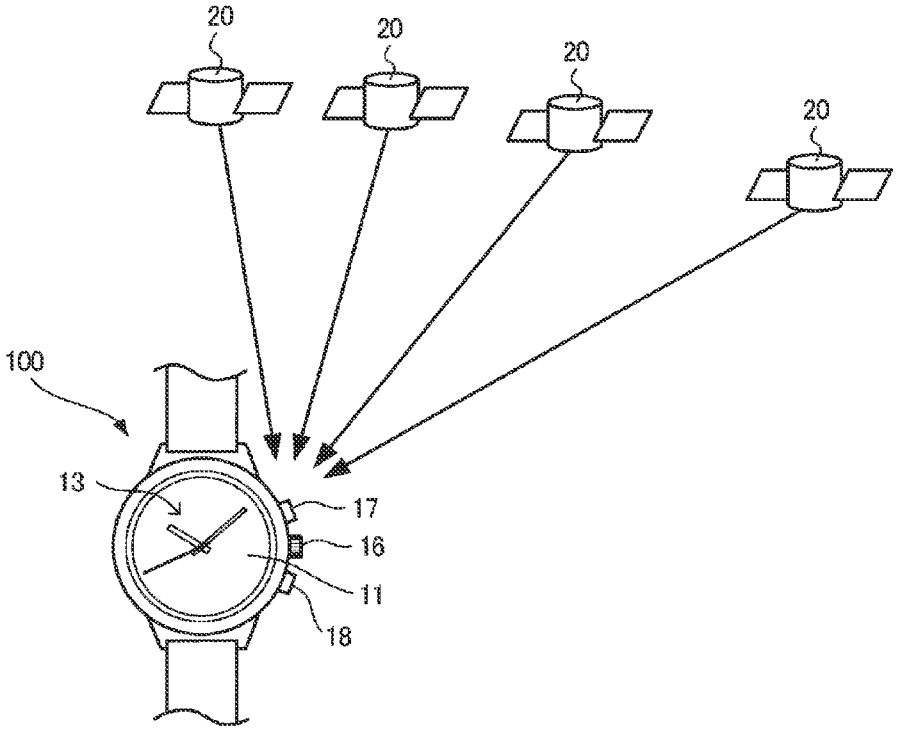
FIG. 1 is an overview of a GPS system including an electronic timepiece 100 with internal antenna according to a preferred embodiment of the invention.

A: Structural Configuration of an Electronic Timepiece with Internal Antenna FIG. 1 shows the basic concept of a GPS system that includes an electronic timepiece with internal antenna 100 (below, electronic timepiece 100) according to a preferred embodiment of the invention. The electronic timepiece 100 is a wristwatch that receives signals (radio signals) from at least one of plural GPS satellites 20 and adjusts the time based thereon, and displays the time on the surface (side) (referred to below as the "face") on the opposite side as the surface (referred to below as the "back") that contacts the wrist. Below, the back side is also referred to as the bottom, and the face side as the top.

A GPS satellite 20 is an example of a positioning information satellite that orbits the Earth on a specific orbit, and transmits a navigation message superimposed on a 1.57542 GHz RF signal (L1 signal). The 1.57542 GHz signal carrying a superimposed navigation message is referred to herein as simply a "satellite signal." These satellite signals are right-handed circularly polarized waves.

The invention is described below using the GPS system as an example of a satellite positioning system, but the invention is not so limited. More particularly, the invention can be used with Global Navigation Satellite Systems (GNSS) such as Galileo (EU), GLONASS (Russia), and Beidou (China), and other positioning information satellites that transmit satellite signals containing time information, including the SBAS and other geostationary or quasi-zenith satellites.

The electronic timepiece 100 may therefore be a wristwatch that receives radio waves (radio signals) from positioning information satellites other than GPS satellites 20, and adjusts the internal time based thereon.

There are currently approximately 31 GPS satellites 20 in the constellation. Only 4 of the 31 satellites are shown in FIG. 1.

Each GPS satellite 20 superimposes a unique pattern called a C/A code (Coarse/Acquisition Code), which is a 1023-chip (1 ms) pseudorandom noise code unique to a specific GPS satellite 20, on the satellite signal. This code is used to identify which GPS satellite 20 transmitted a particular satellite signal. Each chip is a value of +1 or −1, and the C/A code appears to be a random pattern. The C/A code superimposed on the satellite signal can therefore be detected by correlating the satellite signal that is actually received with the known pattern of each C/A code.

Each GPS satellite 20 carries an atomic clock, and the highly precise time information ("GPS time information" below) kept by the atomic clock is included in the satellite signal transmitted by the GPS satellite 20. The time difference of the atomic clock onboard each GPS satellite 20 is measured by the ground control segment, and a time correction parameter for correcting this time difference is also included in the satellite signal. The electronic timepiece 100 receives a satellite signal transmitted from one GPS satellite 20, and adjusts the internal time to the correct time using the GPS time information and time correction parameter contained in the received signal.

Orbit information indicating the position of the GPS satellite 20 on its orbit is contained in the satellite signal. The electronic timepiece 100 can calculate its own position using the GPS time information and orbit information. This position calculation assumes that there is some degree of error in the internal time kept by the electronic timepiece 100. More specifically, in addition to the three parameters for determining the three-dimensional position of the electronic timepiece 100, this time error is also an unknown. The electronic timepiece 100 therefore generally receives satellite signals from four or more GPS satellites, and calculates its own position using the GPS time information and orbit information contained in each of the received signals.

Figure 2:
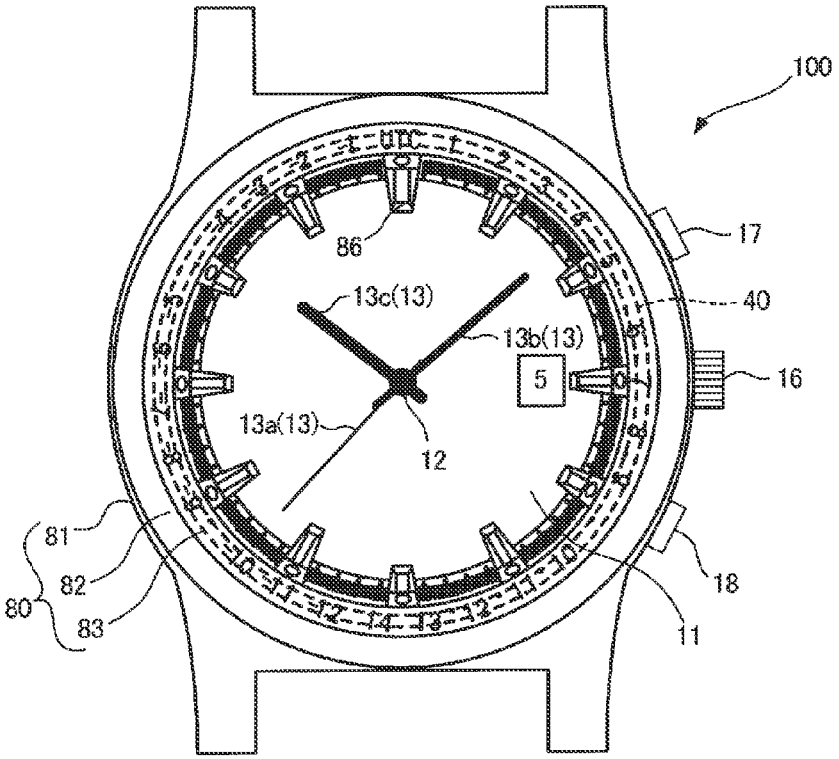
FIG. 2 is a plan view of the electronic timepiece 100.

FIG. 2 is a plan view of the electronic timepiece 100.

As shown in FIG. 2, the electronic timepiece 100 has an outside case 80. The case 80 includes a cylindrical case body 81 made of metal or other conductive material, and a bezel 82 made of ceramic other non-conductive material. The bezel 82 is fit into the case body 81.

An annular dial ring 83 made of plastic or other non-conductive material is disposed inside the bezel 82, and a round dial 11 is disposed inside the dial ring 83. In other words, the dial ring 83 is disposed around the outside of the dial 11. The outside circumference of the round dial 11 is greater than the inside circumference of the dial ring 83, and the dial ring 83 prevents the outside circumference of the dial 11 from being seen. Bar-shaped index markers 86 for indicating the time (hour), for example, are disposed every 30 degrees around the dial ring 83, and such markers are not disposed to the dial 11. The information shown on the dial ring 83 and the information shown on the dial 11 are different from each other, and are not limited to the information shown in the figure.

Hands 13 (13*a* to 13*c*) that turn on a center pivot 12 and indicate the current time are disposed above the dial 11. The dial 11 may also be referred to as the time display unit below.

Further described below, the case 80 has two openings, one each on the face and the back cover sides. The opening on the face side of the case 80 is covered by a glass crystal 84 held by the bezel 82, and the dial 11 and hands 13 (13*a* to 13*c*) can be seen through the crystal 84.

As shown in FIG. 1 and FIG. 2, the electronic timepiece 100 has a crown 16, and pushers 17, 18. By manually operating the crown 16 and pushers 17, 18, the electronic timepiece 100 can be set to a mode (time information acquisition mode) that receives satellite signals from at least one GPS satellite 20 and adjusts the internal time, and a mode (positioning information acquisition mode) that receives signals from plural GPS satellites 20, calculates the current position, and adjusts the time difference of the internal time. The electronic timepiece 100 can also execute the time information acquisition mode and positioning information acquisition mode regularly (automatically).

Figure 3:
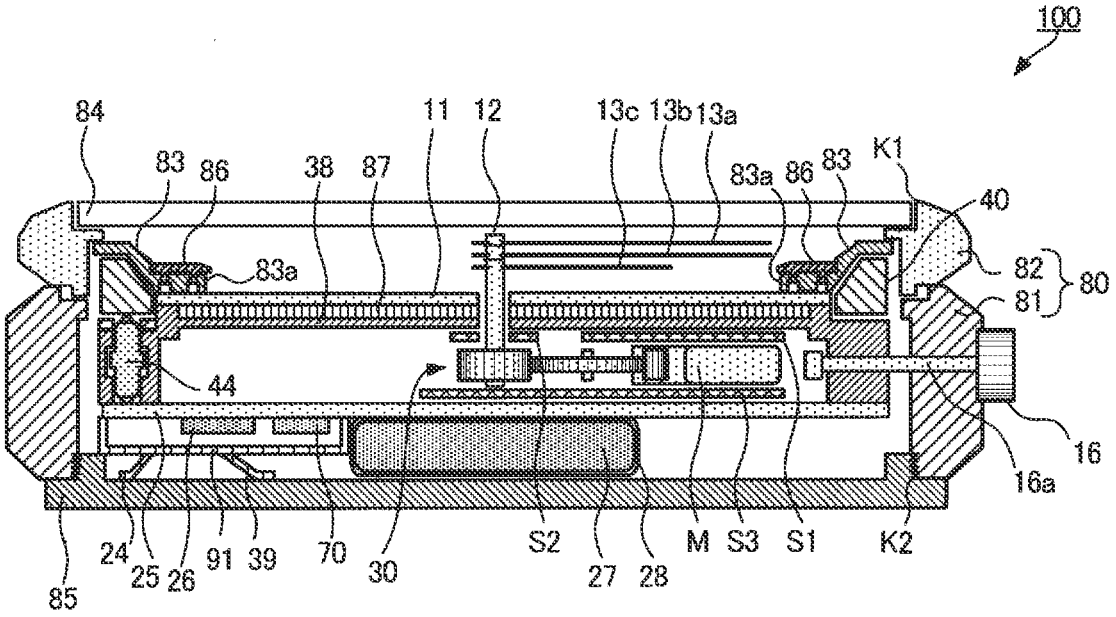
FIG. 3 is a partial section view of the electronic timepiece 100.
Figure 4:
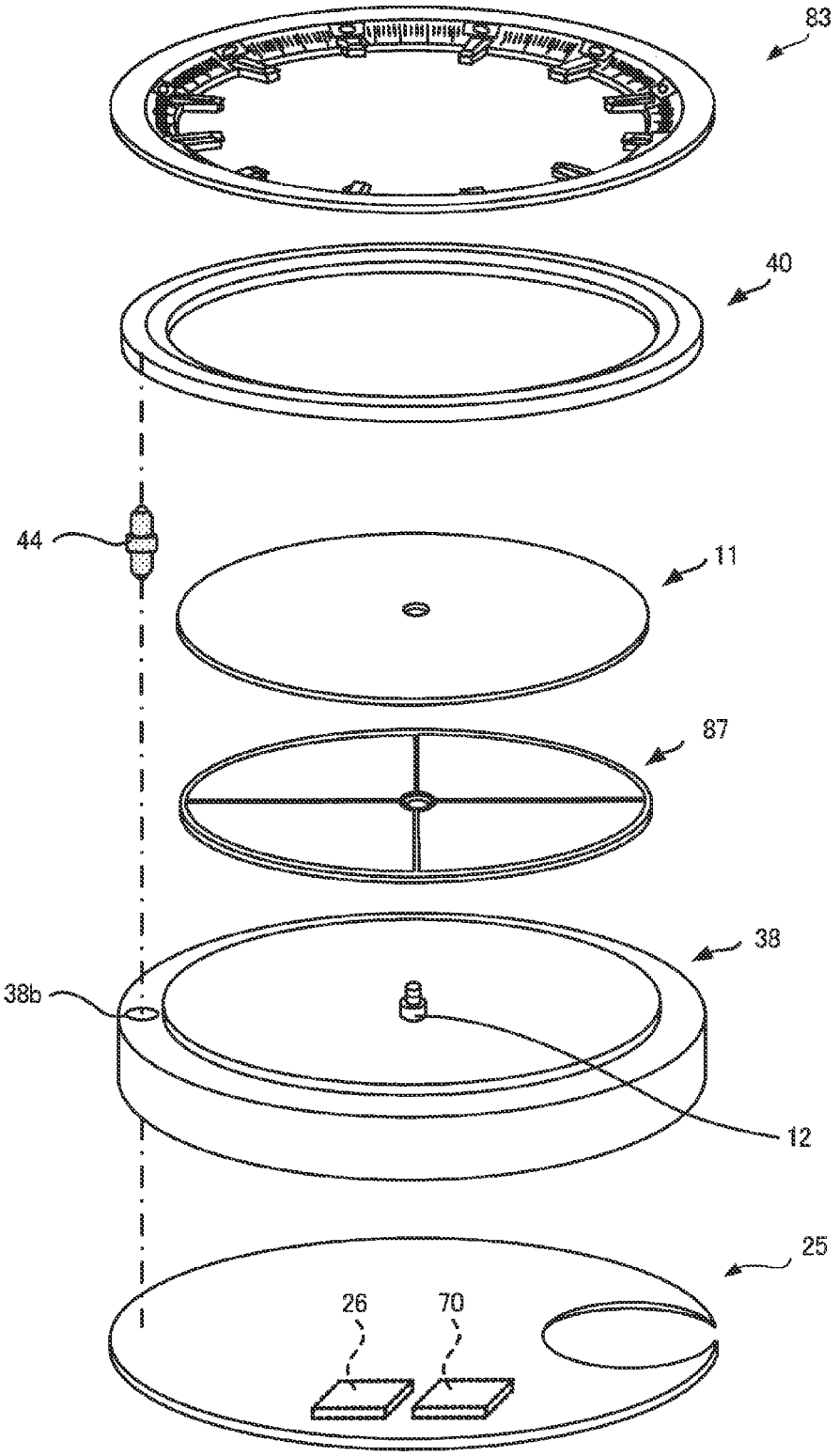
FIG. 4 is an exploded view of part of the electronic timepiece 100.

FIG. 3 is a section view showing part of the internal structure of the electronic timepiece 100, and FIG. 4 is an exploded oblique view showing parts of the electronic timepiece 100. As shown in FIG. 3, the case 80 includes a cylindrical body 81 made of metal or other conductive material, and a bezel 82 made of ceramic or other non-conductive material. The bezel 82 is pressed into the body 81. The case 80 has a top opening K1 on the face side, and a bottom opening K2 on the back side. The top opening K1 on the face side of the case 80 is covered by the round crystal 84, and the bottom opening K2 is covered by a back cover 85 made of metal such as SUS (stainless steel) or Ti (titanium). The case body 81 and back cover 85 screw together, for example.

The ring-shaped (annular) dial ring 83 made of plastic or other non-conductive material is disposed along the inside circumference of the bezel 82 below (on the back cover side of) the crystal 84. The dial ring 83 has protrusions 83*a* formed extending to the inside radially to the dial 11. An index marker 86 made of brass, stainless steel, or other metal is affixed as an index member in each protrusion 83*a*. The dial ring 83 and the index markers 86 are separate parts. The protrusion 83*a* and the index markers 86 are described further below. A main plate 38 made of plastic or other non-conductive material is disposed inside the inside circumference of the case body 81 below the dial ring 83.

A donut-shaped storage space is formed by the main plate 38, the dial ring 83, and inside surface of the case 80. The annular antenna body 40 is housed in this space. The antenna body 40 is therefore housed inside the inside circumference of the bezel 82, and is covered on top by the dial ring 83.

An antenna electrode pattern (element) not shown is formed by a plating process, for example, on the surface of the antenna body 40. The antenna electrode pattern includes a C-shaped loop element, and a curved exciter element that has substantially the same diameter as the diameter of the loop element and is disposed opposing and substantially concentrically to the loop element. The loop element and the exciter element are parallel to each other with a specific gap therebetween, and are electromagnetically coupled. One end of the exciter element bends down and is configured to contact the vertically disposed feed pin 44. The feed pin 44 is electrically connected to the back cover 85 through the circuit board 25, shield 91, and conductive spring 24, the back cover 85 is fastened to the body 81, and the feed pin 44 is therefore also electrically connected to the body 81. As a result, a specific potential is supplied to the antenna electrode pattern of the antenna body 40.

As shown in FIG. 3, an optically transparent dial 11, a solar panel 87 for solar power generation, a center pivot 12 passing through the dial 11 and main plate 38, and plural hands 13 (second hand 13*a*, minute hand 13*b*, hour hand 13*c*) that move around the center pivot 12 and display the current time, are disposed inside the inside circumference of the antenna body 40.

The center pivot 12 extends in the direction between the face and back along the center axis of the case 80. The dial 11 is round and made of plastic or other optically transparent, non-conductive material. As shown in FIG. 3, the dial 11 is disposed between the crystal 84 and main plate 38. A hole through which the center pivot 12 passes is formed in the center of the dial 11. The hands 13 are disposed between the crystal 84 and the dial 11 inside the inside circumference of the antenna body 40.

A drive mechanism (drive unit) 30 that causes the center pivot 12 to turn and drives the plural hands 13 is disposed below (on the back cover side of) the main plate 38. The drive mechanism 30 includes a stepper motor M and wheel train, and drives the hands 13 by the stepper motor M causing the center pivot 12 to turn through the wheel train. More specifically, the drive mechanism 30 causes the center pivot 12 to turn so that the hour hand 13*c* turns one revolution in 12 hours, the minute hand 13*b* turns one revolution in 60 minutes, and the second hand 13*a* turns one revolution in 60 seconds.

The electronic timepiece 100 has a circuit board 25 inside the case 80. The circuit board 25 is made of resin or other material including a dielectric, and is disposed below the drive mechanism 30 (that is, between the drive mechanism 30 and the back cover 85).

A circuit block including a GPS reception unit (radio receiver) 26 and control unit 70 is disposed on the bottom (on the surface facing the back of the wristwatch) of the circuit board 25. The GPS reception unit 26 is a single-chip IC module, for example, and includes analog and digital circuits. The control unit 70 sends control signals to the GPS reception unit 26 and controls the reception operation of the GPS reception unit 26, and controls operation of the drive mechanism 30.

A feed pin 44 made of metal or other conductive material is disposed to the top of the circuit board 25. The feed pin 44 has an internal spring, contacts the feed node of the antenna body 40 through a through-hole formed in a ground plane 90 not shown, and contacts the circuit board 25 through a through-hole 38*b* (see FIG. 4) formed in the main plate 38. The feed node of the antenna body 40 is therefore electrically connected to the circuit board 25 (more precisely, to wiring disposed to the circuit board 25) through the feed pin 44, and a specific potential from the circuit board 25 is supplied to the antenna body 40.

The circuit block including the GPS reception unit 26 and control unit 70 is covered by a shield 91 made of a conductive material. The shield 91 is electrically connected to the ground plane 90 through a circuit support 39, the back cover 85, and the case body 81. The ground potential of the circuit block is supplied to the shield 91. More specifically, the shield 91, back cover 85, case body 81, and ground plane 90 are held at the ground potential of the circuit block, and function as a ground plane.

Magnetic screens S1 and S2 are disposed between the drive mechanism 30 and the main plate 38, and another magnetic screen S3 is disposed between the drive mechanism 30 and circuit board 25. Magnetic screens S1 and S2 are referred to below as a first magnetic screen, and magnetic screen S3 as a second magnetic screen. Magnetic screens S1 to S3 are made of a conductive material with high permeability, such as pure iron.

If there is a speaker or other object that produces a strong magnetic field on the outside of the electronic timepiece 100, the magnetic field can cause the stepper motors M to operate incorrectly. Of the parts of the electronic timepiece 100, metal in the case body 81 and back cover 85 produces a magnetic field when magnetized. Circuit blocks on the circuit board 25 can also produce a magnetic field.

By covering the stepper motors M with magnetic screens S1 to S3 made of a high permeability material, this embodiment of the invention magnetically shields the drive mechanism 30 and prevents the stepper motor M from operating incorrectly due to the magnetic fields described above.

A lithium ion battery or other cylindrically shaped storage battery 27, a battery compartment 28 for holding the storage battery 27, and a solar panel 87 for photovoltaic power generation are also disposed inside the case 80 of the electronic timepiece 100.

The solar panel 87 is a round disc having plural solar cells (photovoltaic devices) that convert light energy to electrical energy (power) connected in series. The solar panel 87 is disposed inside the inside circumference of the antenna body 40 and between the main plate 38 and dial 11. A center hole through which the center pivot 12 passes is formed in the center of the solar panel 87.

The storage battery 27 is charged by the power produced by the solar panel 87. The battery compartment 28 for holding the storage battery 27 is below the circuit board 25 (that is, between the circuit board 25 and back cover 85).

The crown 16 and pushers 17, 18 (FIG. 2) are disposed on the outside of the case 80. Movement of the crown 16 resulting from the user of the electronic timepiece 100 operating the crown 16 is transferred through the stem 16*a* passing through the case 80 to the drive mechanism 30. Movement of the pusher 17 (or 18) produced by the user of the electronic timepiece 100 pressing the pusher 17 (or 18) is transferred to a switch not shown through the corresponding button stem not shown passing through the case 80. These switches convert pressure from the pusher 17 (or 18) to an electrical signal, and output the signal to the control unit 70.

The crown 16, stem 16*a*, pushers 17, 18, and button stems are generically referred to below as operators.

B: Circuit Configuration of an Electronic Timepiece with Internal Antenna

Figure 5:
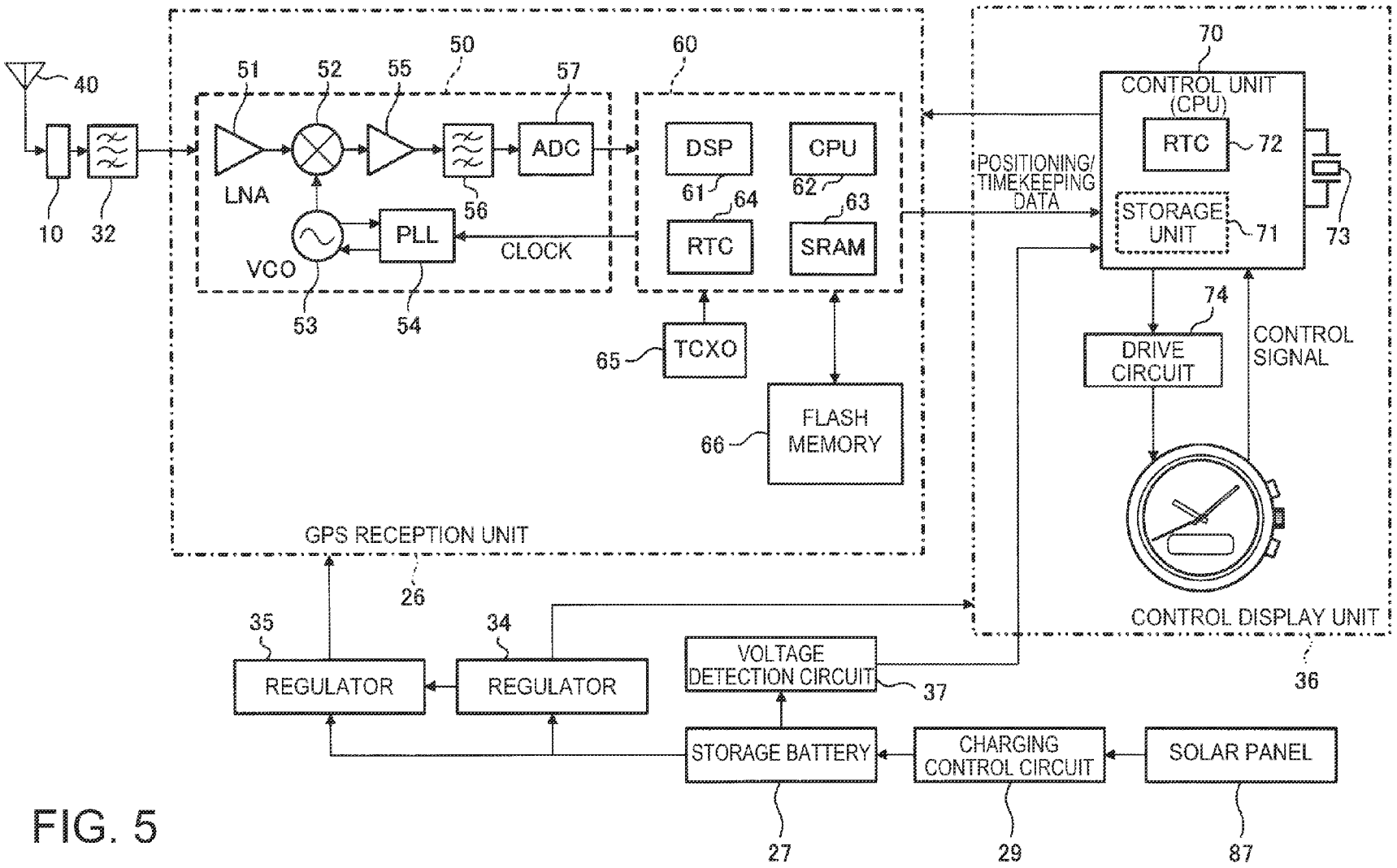
FIG. 5 is a block diagram showing the circuit configuration of the electronic timepiece 100.

FIG. 5 is a block diagram showing the circuit configuration of the electronic timepiece 100. As shown in FIG. 5, the electronic timepiece 100 includes a GPS reception unit 26 and a control display unit 36. The GPS reception unit 26 executes processes related to receiving satellite signals, locking onto GPS satellites 20, generating positioning information, and generating time correction information, for example. The control display unit 36 executes processes including keeping the internal time and adjusting the internal time.

A solar panel 87 charges the storage battery 27 through the charging control circuit 29.

The electronic timepiece 100 has regulators 34 and 35, and the storage battery 27 supplies drive power through a regulator 34 to the control display unit 36, and supplies drive power through another regulator 35 to the GPS reception unit 26.

The electronic timepiece 100 also has a voltage detection circuit 37 that detects the voltage of the storage battery 27.

Regulator 35 could be split into a regulator 35-1 (not shown) that supplies drive power to the RF unit 50 (described below), and a regulator 35-2 (not shown) that supplies drive power to a baseband unit 60 (described below). In this embodiment, regulator 35-1 could be disposed in the RF unit 50.

The electronic timepiece 100 also has the antenna body 40 and a SAW (surface acoustic wave) filter 32. As described with reference to FIG. 1, the antenna body 40 receives satellite signals from plural GPS satellites 20. However, because the antenna body 40 also receives noise in addition to the satellite signals, the SAW filter 32 extracts the satellite signals from the signals received by the antenna body 40. In other words, the SAW filter 32 functions as a bandpass filter that passes signals in the 1.5 GHz waveband.

The GPS reception unit 26 includes the RF (radio frequency) unit 50 and baseband unit 60. As described below, the GPS reception unit 26 executes a process that extracts satellite information including GPS time information and orbit information contained in the navigation message from the 1.5 GHz satellite signal extracted by the SAW filter 32.

The RF unit 50 includes a LNA (low noise amplifier) 51, mixer 52, VCO (voltage controlled oscillator) 53, PLL (phase-locked loop) circuit 54, IF (intermediate frequency) amplifier 55, IF filter 56, and A/D converter 57.

The satellite signal passed by the SAW filter 32 is amplified by the LNA 51. The satellite signal amplified by the LNA 51 is mixed by the mixer 52 with the clock signal output by the VCO 53, and down-converted to a signal in the intermediate frequency band. The PLL circuit 54 phase compares a clock signal obtained by frequency dividing the output clock signal of the VCO 53 with a reference clock signal, and synchronizes the output clock signal of the VCO 53 to the reference clock signal. As a result, the VCO 53 can output a stable clock signal with the frequency precision of the reference clock signal. Note that several megahertz, for example, can be selected as the intermediate frequency.

The signal from the mixer 52 is amplified by the IF amplifier 55. However, mixing by the mixer 52 also produces a high frequency component of several GHz in addition to the IF signal. The IF amplifier 55 therefore amplifies both the IF signal and the high frequency component of several GHz. The IF filter 56 therefore passes the IF signal and removes the high frequency component of several GHz (more accurately, attenuates the signal to a specific level or less). The IF signal passed by the IF filter 56 is converted to a digital signal by the A/D converter 57.

The baseband unit 60 includes, for example, a DSP (digital signal processor) 61, CPU (central processing unit) 62, SRAM (static random access memory) 63, and RTC (real-time clock) 64. A TCXO (temperature compensated crystal oscillator) 65 and flash memory 66 are also connected to the baseband unit 60.

The temperature compensated crystal oscillator (TCXO) 65 generates a reference clock signal of a substantially constant frequency regardless of temperature. Time zone information, for example, is stored in flash memory 66. The time zone information defines the time difference between the current location and UTC based on specific coordinates (such as latitude and longitude).

The baseband unit 60 executes a process that demodulates the baseband signal from the digital signal (IF signal) output from the A/D converter 57 of the RF unit 50 when set to the time information acquisition mode or the positioning information acquisition mode.

In addition, when the time information acquisition mode or the positioning information acquisition mode is set, the baseband unit 60 executes a process that generates a local code of the same pattern as each C/A code, and correlates the local codes to the C/A code contained in the baseband signal, in the satellite search step. The baseband unit 60 adjusts the timing when the local code is generated to find the peak correlation to each local code, and when the correlation equals or exceeds a threshold value, confirms synchronization with the GPS satellite 20 matching the local code (that is, confirms locking onto a GPS satellite 20). Note that the GPS system uses a CDMA (Code Division Multiple Access) method whereby all GPS satellites 20 transmit satellite signals on the same frequency using different C/A codes. The GPS satellites 20 that can be locked onto can therefore be found by identifying the C/A code contained in the received satellite signal.

To acquire the satellite information from the satellite signal of the GPS satellite 20 that was locked onto in the time information acquisition mode or the positioning information acquisition mode, the baseband unit 60 executes a process that mixes the baseband signal with the local code of the same pattern as the C/A code of the GPS satellite 20 that was locked.

The navigation message containing the satellite information of the GPS satellite 20 that was locked onto is demodulated in the mixed signal. The baseband unit 60 then executes a process to detect the TLM word (preamble data) of each subframe in the navigation message, and acquire (such as store in SRAM 63) satellite information such as the orbit information and GPS time information contained in each subframe. The GPS time information as used here is the week number (WN) and Z count, but the Z count data alone could be acquired if the week number was previously acquired. The baseband unit 60 generates the time adjustment information required to correct the internal time based on the satellite information.

In the time information acquisition mode, the baseband unit 60 more specifically calculates the time based on the GPS time information, and generates time correction information. The time correction information in the time information acquisition mode may be the GPS time information, or information about the time difference between the GPS time and internal time.

However, in the positioning information acquisition mode, the baseband unit 60 more specifically calculates the position based on the GPS time information and orbit information, and acquires the location information (more specifically calculates the latitude and longitude of the electronic timepiece 100 when the satellite signals were received).

Next, the baseband unit 60 references the time difference (time zone) information stored in flash memory 66, and acquires the time difference at the coordinates (such as latitude and longitude) of the electronic timepiece 100 determined from the positioning information. The baseband unit 60 thus generates satellite time data (GPS time information) and time zone (time difference) data as the time correction information. The time correction information used in the positioning information acquisition mode may thus be the GPS time information and time zone information as described above, but the time difference between the internal time and the GPS time could be used instead of the GPS time information.

Note that the baseband unit 60 can generate the time correction information using the GPS time information from one GPS satellite 20, or the baseband unit 60 can generate the time correction information from satellite information from a plurality of GPS satellites 20.

Operation of the baseband unit 60 is synchronized to the reference clock signal output by the TCXO 65. The RTC 64 generates the timing for satellite signal processing. The RTC 64 increments up at the reference clock signal output from the TCXO 65.

The control display unit 36 includes a control unit 70, crystal oscillator 73, and drive circuit 74.

The control unit 70 includes a storage unit 71 and a RTC (real-time clock) 72, and controls various operations. The control unit 70 can be rendered with a CPU, for example. The control unit 70 outputs control signals to the GPS reception unit 26, and controls reception by the GPS reception unit 26. The control unit 70 also controls operation of regulators 34, 35 based on output from the voltage detection circuit 37. The control unit 70 also controls movement of the hands 13 through the drive circuit 74.

Received data is stored in the storage unit 71. The control unit 70 adjusts the internal time information based on the received data. The internal time information is information about the time kept by the electronic timepiece 100, is counted by the continuously driven RTC 72, and is updated based on the reference clock signal generated by the crystal oscillator 73. The internal time can therefore be updated and the hands moved even when power is not supplied to the GPS reception unit 26.

When the time information acquisition mode is set, the control unit 70 controls operation of the GPS reception unit 26, corrects the internal time based on the GPS time, and stores the time in the storage unit 71. More specifically, the internal time is corrected to UTC (Coordinated Universal Time) by adding a UTC off set to the acquired GPS time.

When the positioning information acquisition mode is set, the control unit 70 controls operation of the GPS reception unit 26, corrects the internal time based on the satellite time data (GPS time) and time zone (time difference) data, and stores the time in the storage unit 71.

C: Protrusions of the Dial Ring and Index Markers

Figure 6:
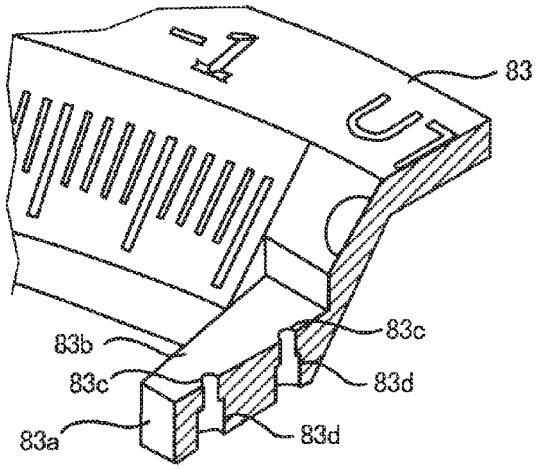
FIG. 6 is an oblique section view of part of the dial ring 83 of the electronic timepiece 100.
Figure 8:
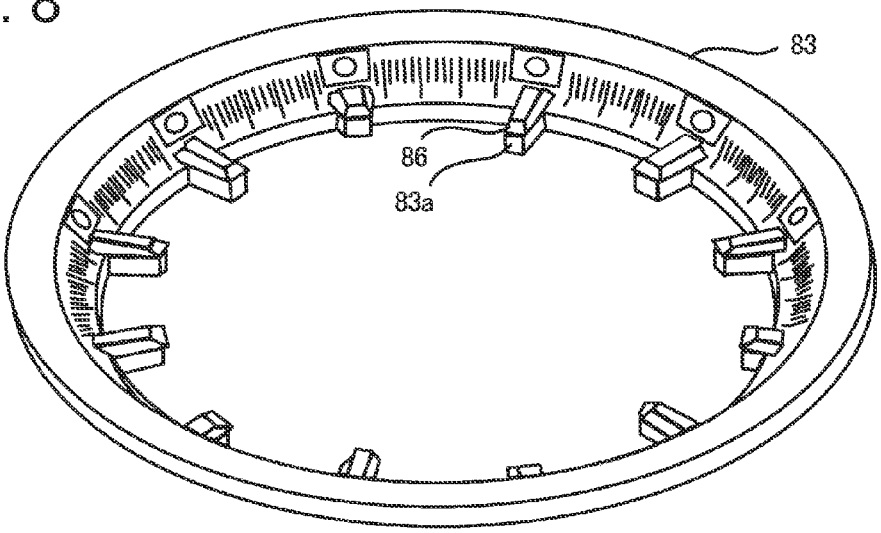
FIG. 8 is an oblique view of the dial ring 83 of the electronic timepiece 100.

FIG. 6 is an oblique section view showing a part of the dial ring 83 in this embodiment of the invention. As shown in FIG. 6, the dial ring 83 in this embodiment has one or more protrusions 83*a* extending in the radial direction from the dial ring 83. The radial direction means the direction from the center of the dial ring 83 to the dial ring (or from the dial ring 83 to the center of the dial ring 83). The protrusions 83*a* are formed extending to the inside (toward the center of the dial ring 83) in the radial direction. Each protrusion 83*a* has a flat part 83*b* parallel to the dial 11, and two first holes 83*c* are formed in the flat part 83*b*. As shown in FIG. 8, a protrusion 83*a* is disposed to the dial ring 83 at the positions of 1:00 to 12:00. FIG. 8 is an oblique view of the dial ring 83.

Figure 7:
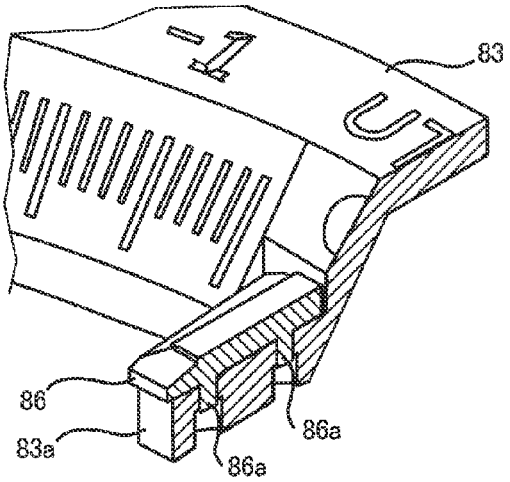
FIG. 7 is an oblique section view of part of the dial ring 83 of the electronic timepiece 100 with an index marker 86 attached.
Figure 9:
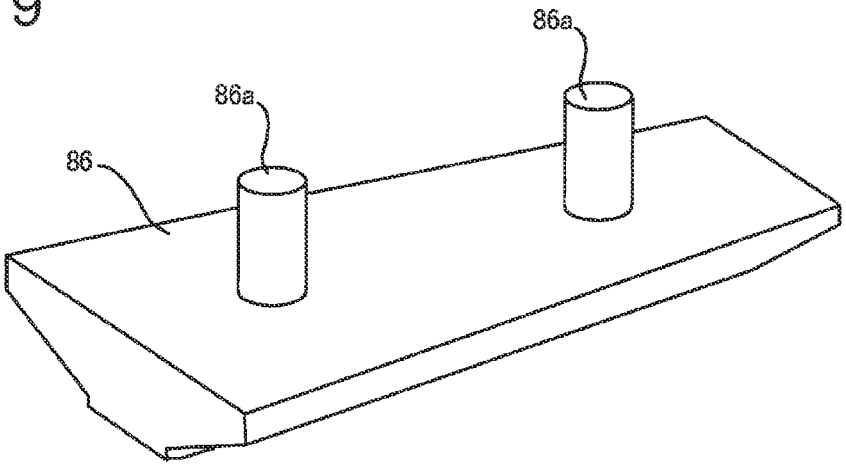
FIG. 9 is an oblique view of the index marker 86.
Figure 10:
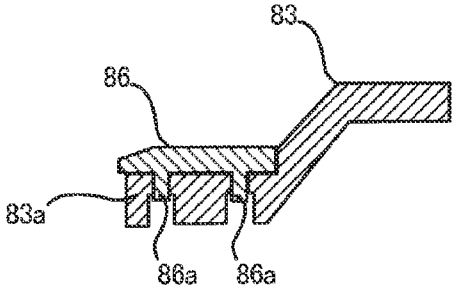
FIG. 10 is a section view showing the index marker 86 attached to the dial ring 83 of the electronic timepiece 100.

An index marker 86 shaped as shown in FIG. 9 is attached to each protrusion 83*a*. The distal end of the index marker 86 is sloped, but the remaining part of the body is formed with a constant thickness. FIG. 9 is an oblique view of the index marker 86 shown with the surface that contacts the flat part 83*b* of the protrusion 83*a* facing up in FIG. 9. As shown in FIG. 9, the index marker 86 has two posts 86*a* that are fit into the two first holes 83*c* of the protrusion 83*a*. In this embodiment of the invention as shown in FIG. 7 and FIG. 10, the posts 86*a* of the index marker 86 are fit into the first holes 83*c* in the protrusion 83*a* to attach and temporarily hold the index marker 86 to the protrusion 83*a*.

Figure 11:
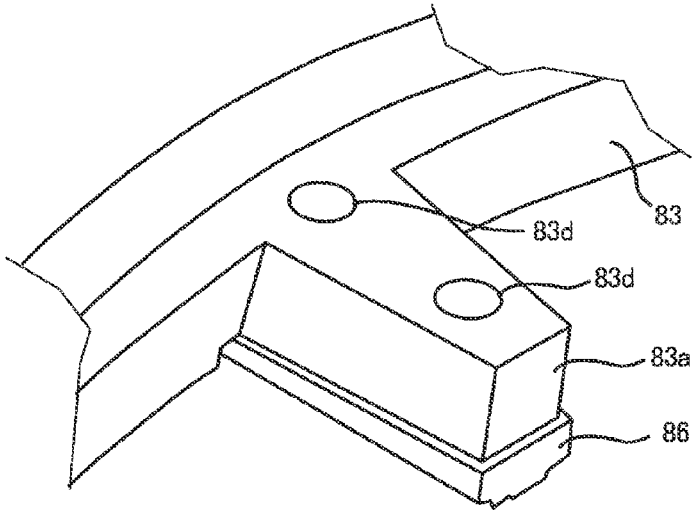
FIG. 11 is an oblique view showing part of the dial ring 83 of the electronic timepiece 100 with the index marker 86 attached.

Second holes 83*d* are formed in the back side of the protrusion 83*a* and are exposed when the back of the flat part 83*b* of the protrusion 83*a* is facing up as shown in FIG. 11. As shown in FIG. 6 and FIG. 7, the second holes 83*d* communicate with the first holes 83*c*. In this embodiment of the invention, the posts 86*a* of the index marker 86 are bonded and fixed in the first holes 83*c* of the protrusion 83*a* by injecting (applying) adhesive from the second hole 83*d* side. Because the adhesive can therefore not be seen, the appearance is not impaired.

Figure 12:
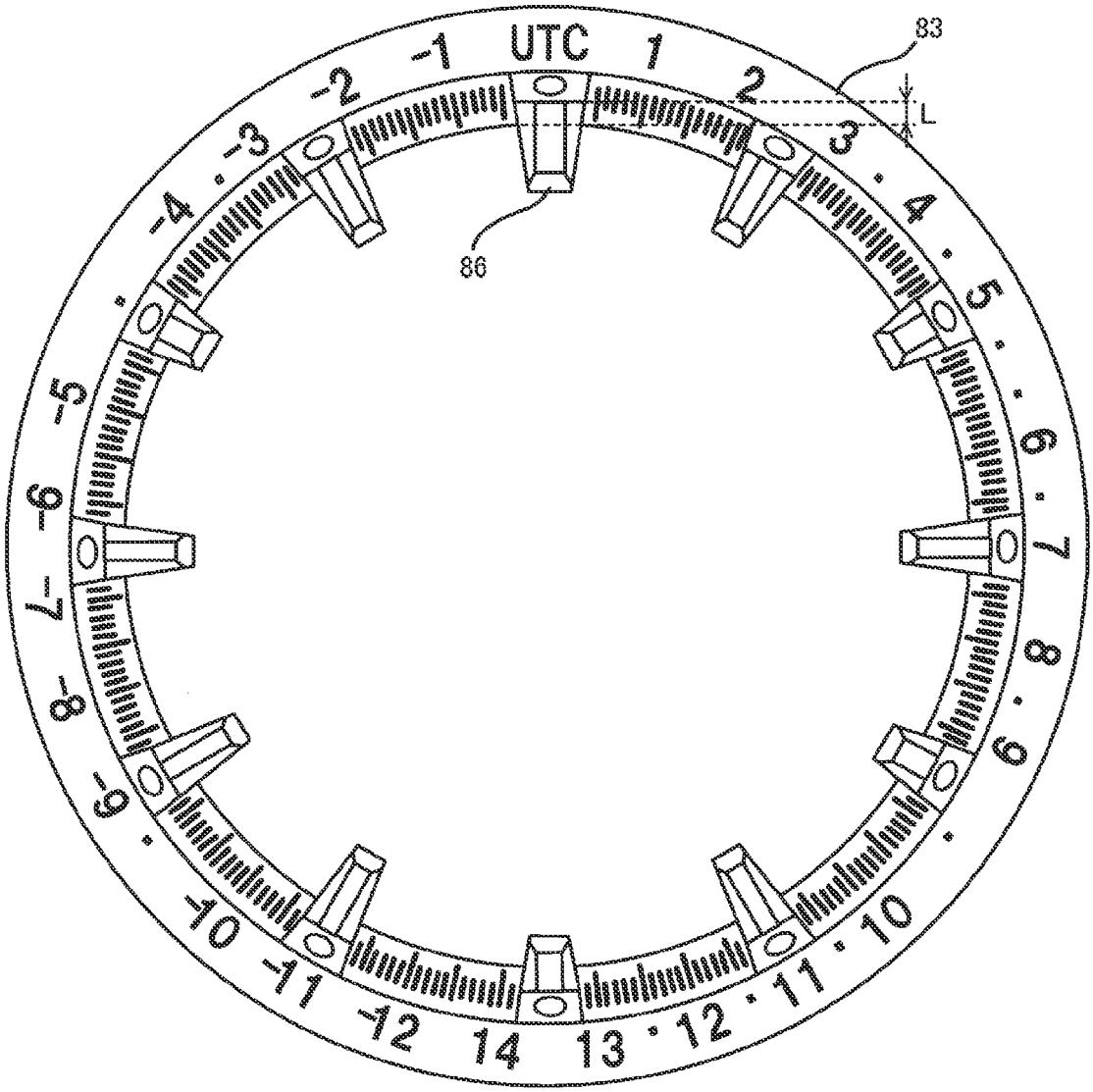
FIG. 12 is a plan view of the dial ring 83 of the electronic timepiece 100 with the index markers 86 attached.

FIG. 12 is a plan view of the dial ring 83 with the index markers 86 fastened to the protrusions 83*a*. As shown in FIG. 12, the index markers 86 in this embodiment are attached to the positions of 1:00 to 12:00 corresponding to the protrusions 83*a*. The index markers 86 are of three different sizes. The index markers 86 at 2:00, 4:00, 6:00, and 10:00 are smallest. The index markers 86 at 1:00, 3:00, 5:00, 7:00, 8:00, 9:00, and 11:00 are a middle size. The index marker 86 at 12:00 is largest.

The length of the index markers 86 in the radial direction of the dial ring 83, and the width of the index markers 86 along the circumference of the dial ring 83, are greater than the corresponding length and width of the protrusions 83*a*, and as shown in FIG. 12, the protrusions 83*a* are hidden by the index markers 86 and cannot be seen in plan view. The appearance is therefore not impaired. The outside circumference end of the index markers 86 in the radial direction of the dial ring 83 is positioned length L from the inside circumference edge of the dial ring 83 to the outside circumference side of the dial ring 83 as shown in FIG. 12. As a result, the visible area of the dial 11 is greater than in a configuration in which the index markers 86 are attached to the dial 11.

The reception sensitivity of the antenna body 40 is also not reduced because the index markers 86 are located at positions not overlapping the antenna body 40 in plan view.

Because the index markers are made of metal and separately from the dial ring in this embodiment of the invention, the design and appearance can be improved. Furthermore, because the index markers are affixed to the dial ring, the visible area of the dial can be increased.

Embodiment 2

Figure 13:
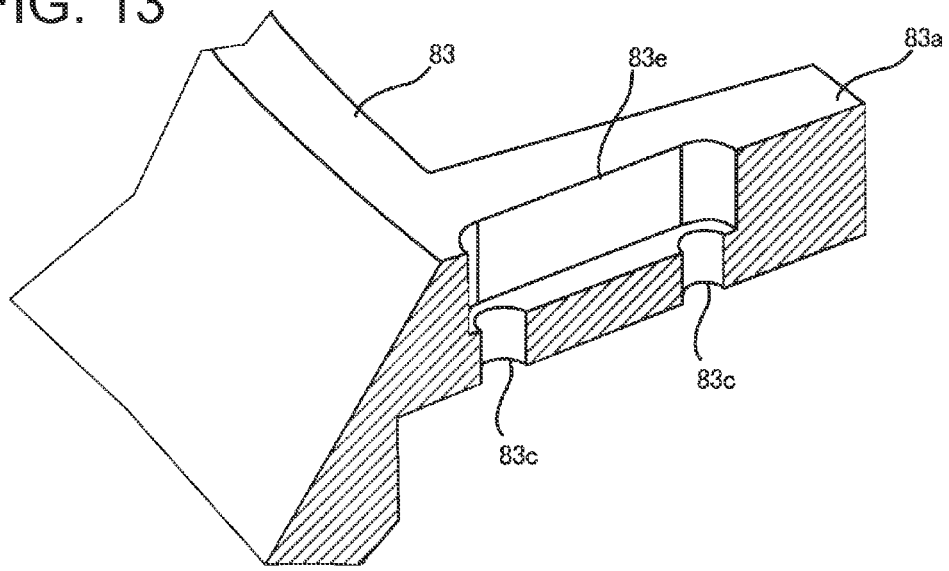
FIG. 13 is an oblique section view showing part of the dial ring 83 of a electronic timepiece 100 according to a second embodiment of the invention.

A second embodiment of the invention is described next with reference to FIG. 13 to FIG. 18. As shown in the figures with the back of the flat part 83*b* of the protrusion 83*a* facing up, a single oval hole is formed as a second hole 83*e* in the back of the flat part 83*b* in this embodiment. As shown in FIG. 13, this single oval second hole 83*e* in this embodiment also communicates with the first holes 83*c* in the protrusion 83*a*.

Figure 14:
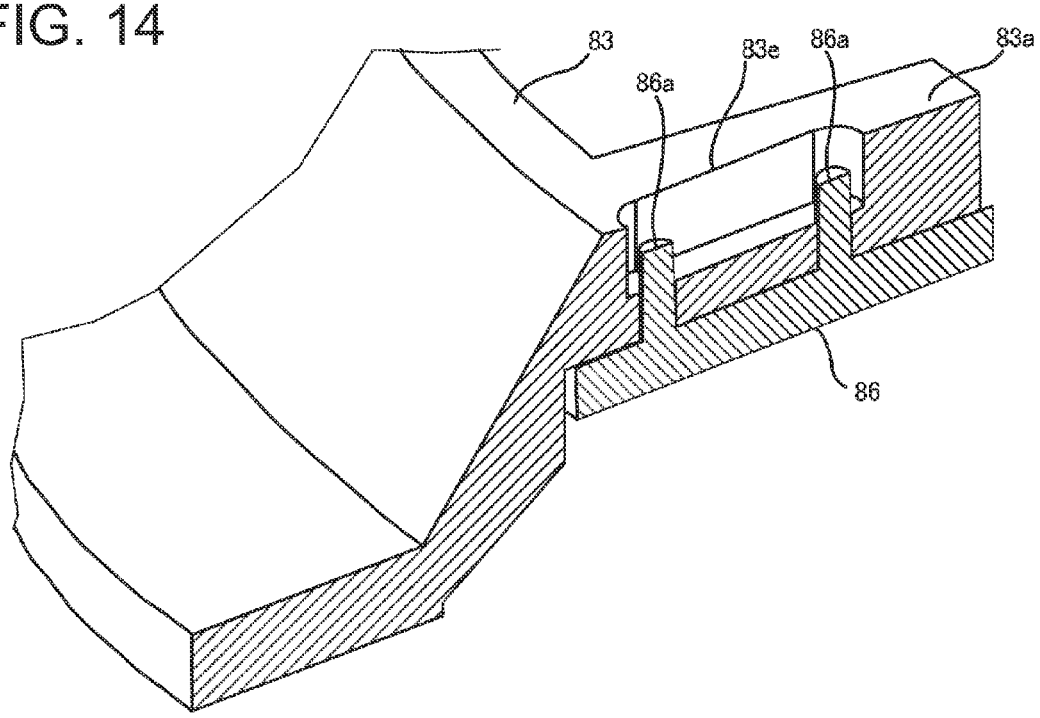
FIG. 14 is an oblique section view showing part of the dial ring 83 of a electronic timepiece 100 according to a second embodiment of the invention with an index marker 86 attached.
Figure 15:
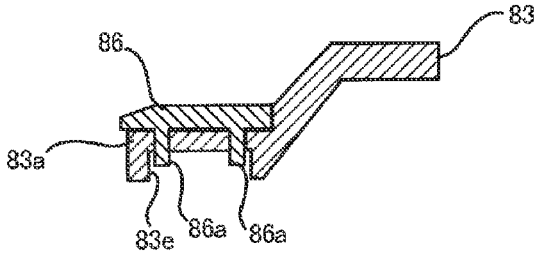
FIG. 15 is a section view of the dial ring 83 of a electronic timepiece 100 according to a second embodiment of the invention with an index marker 86 attached.
Figure 16:
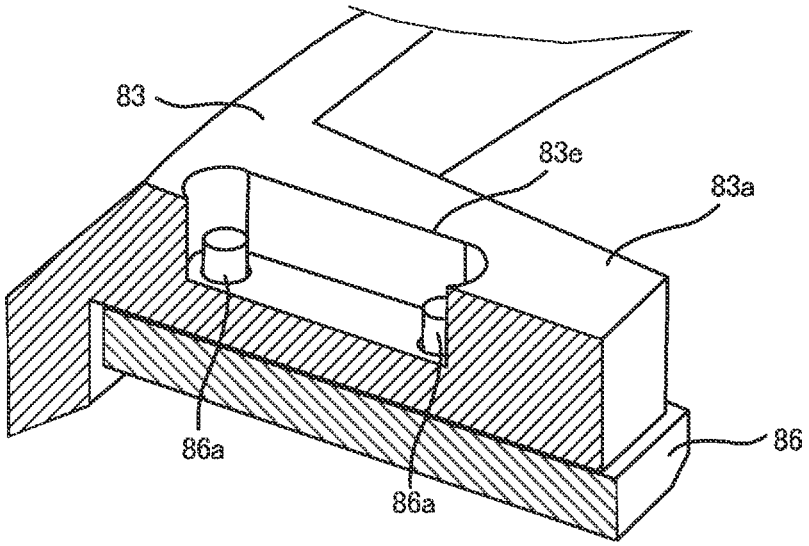
FIG. 16 is an oblique section view showing part of the dial ring 83 of a electronic timepiece 100 according to a second embodiment of the invention with an index marker 86 attached.
Figure 17:
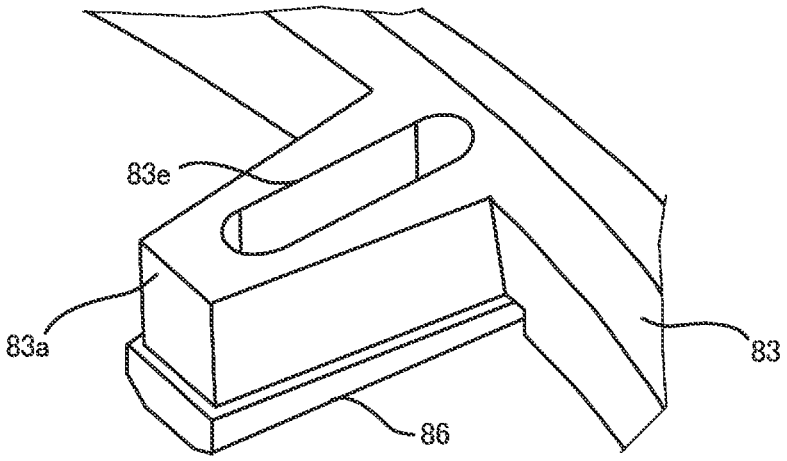
FIG. 17 is an oblique view showing part of the dial ring 83 of a electronic timepiece 100 according to a second embodiment of the invention with an index marker 86 attached.

When the two posts 86*a* of the index marker 86 are fit into the two first holes 83*c* of the protrusion 83*a* as shown in FIG. 14 to FIG. 16, the size of the second hole 83*e* is very large compared with the area where the first holes 83*c* and the posts 86*a* fit together. As a result, when the second hole 83*e* is facing up as shown in FIG. 17 and adhesive is injected to the second hole 83*e*, air can easily escape from inside the second hole 83*e*, and adhesive can be easily injected to the bottom of the second hole 83*e*. A pool of adhesive also forms in the second hole 83*e*, adhesion therefore increases, and strength improves.

Figure 18:
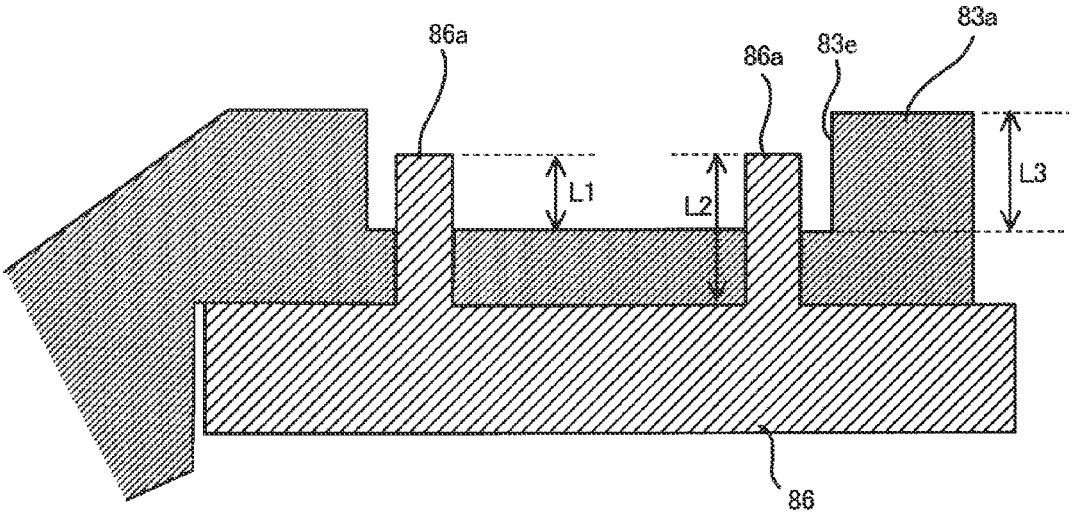
FIG. 18 is a section view of the dial ring 83 of a electronic timepiece 100 according to a second embodiment of the invention with an index marker 86 attached.

As shown in FIG. 18, the length L2 of the posts 86*a* in this embodiment is set so that when the index marker 86 is installed, the length L1 protruding from the second hole 83*e* is greater than or equal to ½, and is preferably greater than or equal to ⅔, the depth L3 of the second hole 83*e*. This configuration increases the area that can be fixed by adhesive, and can increase strength. Note that this configuration can also be applied to the first embodiment described above.

Embodiment 3

Figure 19:
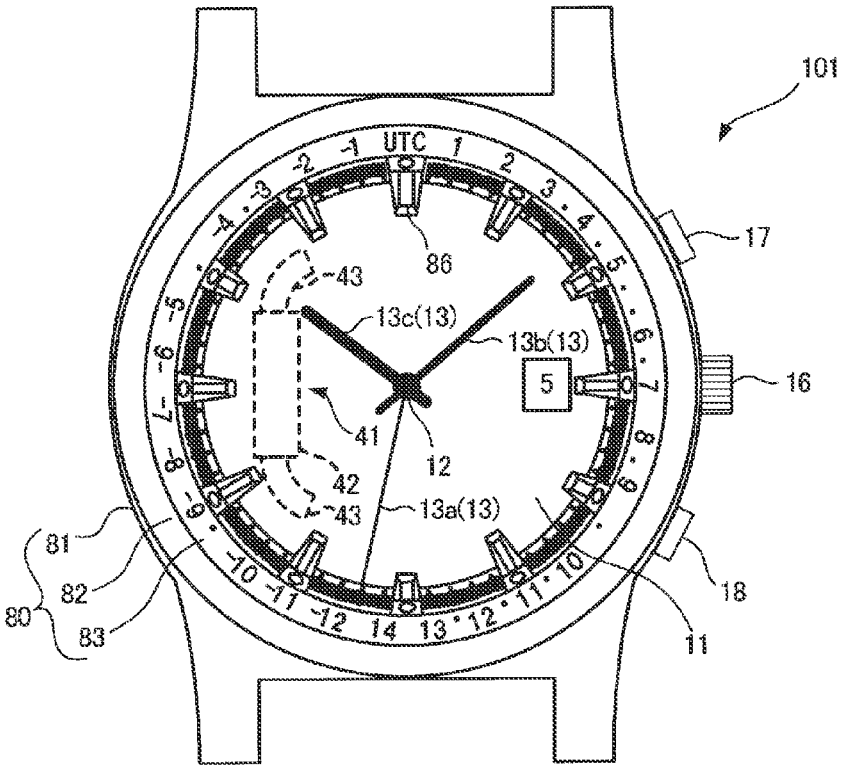
FIG. 19 is a plan view of a radio-controlled timepiece 101 according to a third embodiment of the invention.

A third embodiment of the invention is described next with reference to FIG. 19. This embodiment is an example applying a dial ring with index markers according to the invention to a radio-controlled timepiece that receives radio signals transmitted from an external source and adjusts the time accordingly.

An example of the radio signals received in this timepiece are long-wave standard time signals transmitted from a standard time signal base station, for example. As shown in FIG. 19, the antenna body 41 of the radio-controlled timepiece 101 is configured with a coil 42 wound around a magnetic core (antenna core) 43, and may be insulated by a cationic electrode position coating with excellent corrosion resistance as needed. The magnetic core 43 is made by bonding approximately 10 to 30 layers of a stamped or etched amorphous cobalt alloy foil as a magnetic foil material, and applying an annealing or other heat process to stabilize its magnetic properties. The middle portion of this magnetic core 43 is straight and wrapped with the coil 42, and the curved, flat amorphous foil at the ends is stacked in the thickness direction of the timepiece inside an antenna frame not shown having the same flat shape.

The antenna body 41 thus comprised is disposed to the 9:00 side of the timepiece center. The index markers 86 are also disposed to positions not overlapping the antenna body 41 in plan view in this embodiment, and therefore do not reduce the reception sensitivity of the antenna body 41.

Variations

The invention is not limited to the foregoing embodiment, and can be varied in many ways such as described in the following variations. One or more of the variations described below can also be desirably combined.

Variation 1

The dial ring 83 is made of plastic, and the index markers 86 are made of metal in the embodiments described above. However, the invention is not so limited and the dial ring 83 may be metal while the index markers 86 are made of plastic, glass, or jewels, for example. A luxurious appearance can also be achieved by plating plastic index markers 86 with metal, for example.

Variation 2

The flat part 83*b* of the protrusion 83*a* is described as parallel to the dial 11 in the foregoing embodiments. However, the invention is not so limited and the flat part 83*b* may be configured to slope toward the dial 11, for example. The thickness of the index markers 86 is also described as constant in the embodiments described above, but the invention is not so limited. For example, the thickness of the index marker 86 may change so that the surface of the index marker 86 slopes to the flat part 83*b* when the index marker 86 is attached thereto.

Variation 3

The foregoing embodiments describe examples applying the invention to an electronic timepiece with an internal antenna or a radio-controlled timepiece. However, the invention is not so limited, and can also be applied to timepieces that do not have an antenna.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A timepiece comprising:

a dial;

an annular member disposed around the outside circumference of the dial and having a plurality of protruding parts that protrude inward in the radial direction of the annular member; and a plurality of index markers each of which is disposed to a corresponding one of the plurality of protruding parts so that each of the plurality of protruding parts is completely hidden by the corresponding one of the plurality of index markers so as not to be visible in plan view, each of the plurality of index markers including a first material;

wherein each of the plurality of protruding parts is made of a second material that is different than the first material.

2. The timepiece described in claim 1, wherein:

the second material is plastic; and the first material is metal.

3. The timepiece described in claim 1, wherein:

the outside end of one of the plurality of index markers in the radial direction is positioned further to the outside in the radial direction than the inside edge of the annular member in the radial direction.

4. The timepiece described in claim 1, wherein:

one of the plurality of index markers is fastened to the annular member by adhesive.

5. The timepiece described in claim 1, wherein:

one of the plurality of index markers has a post member;

the protruding part corresponding to the one of the plurality of index markers has a first hole at a position corresponding to the post member; and the post member is fit into the first hole and fastened in the first hole by adhesive.

6. The timepiece described in claim 5, wherein:

the protruding part corresponding to the one of the plurality of index markers has a second hole that communicates with the first hole from the opposite side as the side in which the first hole is formed, and the adhesive is applied from the second hole side.

7. The timepiece described in claim 6, wherein:

there are plural post members and first holes; and the second hole is a single oval hole that communicates with the plural first holes.

8. The timepiece described in claim 1, wherein:

the length of one of the plurality of protruding parts in the radial direction of the annular member, and the width of the one of the plurality of protruding parts in the circumferential direction of the annular member, are less than the length in the radial direction and the width in the circumferential direction of the corresponding index marker.

9. The timepiece described in claim 6, wherein:

when the post member is fastened in the first hole or the second hole, the length of the post member that protrudes from the first hole or the second hole is greater than or equal to ½ the depth of the first hole or the second hole.

10. The timepiece described in claim 1, wherein:

one of the plurality of protruding parts has a portion that is parallel to the dial; and the index marker corresponding to the one of the plurality of protruding parts is disposed to the parallel portion.

11. The timepiece described in claim 1, wherein:

one of the plurality of index markers has a constant thickness.

12. The timepiece described in claim 1, further comprising:

an annular antenna that receives radio signals, the annular antenna being covered by the annular member and being disposed to a position not overlapping one of the plurality of index markers in the plan view;

wherein the dial is disposed inside an inside circumference of the annular antenna.

* * * * *